US011511916B1

(12) United States Patent
Bernardo

(10) Patent No.: US 11,511,916 B1
(45) Date of Patent: Nov. 29, 2022

(54) TOP CLOSURE ASSEMBLY AND DRINKING BOTTLES INCLUDING THE SAME

(71) Applicant: Brandon Bernardo, Boca Raton, FL (US)

(72) Inventor: Brandon Bernardo, Boca Raton, FL (US)

( * ) Notice: Subject to any disclaimer, the term of this patent is extended or adjusted under 35 U.S.C. 154(b) by 28 days.

(21) Appl. No.: 17/162,692

(22) Filed: Jan. 29, 2021

Related U.S. Application Data

(60) Provisional application No. 62/967,405, filed on Jan. 29, 2020.

(51) Int. Cl.
*B65D 47/24* (2006.01)
*A45F 3/16* (2006.01)

(52) U.S. Cl.
CPC ..... *B65D 47/246* (2013.01); *A45F 3/16* (2013.01); *B65D 2547/06* (2013.01)

(58) Field of Classification Search
CPC ..... B65D 47/246; A45F 3/16
USPC ..... 222/552
See application file for complete search history.

(56) References Cited

U.S. PATENT DOCUMENTS 230,730 A * 8/1880 Austen ..... B65D 47/242 251/215
302,698 A * 7/1884 Wirz ..... B65D 47/242 222/520
1,335,034 A * 3/1920 Squier ..... 222/545
3,184,091 A * 5/1965 Hoffman ..... B65D 39/082 251/351
5,465,876 A * 11/1995 Crisci ..... B65D 47/243 222/541.9
6,070,767 A * 6/2000 Gardner ..... A45F 3/16 222/529
6,095,382 A * 8/2000 Gross ..... B65D 47/242 222/521
8,336,667 B2 * 12/2012 Tzarum ..... B60R 25/096 152/415
8,636,166 B2 * 1/2014 Lane ..... B65D 47/242 222/549
9,950,827 B1 * 4/2018 Lau ..... B65D 23/001
(Continued)

FOREIGN PATENT DOCUMENTS

WO WO-2019083492 A1 * 5/2019 ..... B05C 17/005
WO WO-2019231662 A1 * 12/2019 ..... A45F 3/16

*Primary Examiner* — Paul R Durand
*Assistant Examiner* — Michael J. Melaragno
(74) *Attorney, Agent, or Firm* — Mark D. Bowen, Esq.; Malin Haley DiMaggio & Bowen, P.A.

(57) ABSTRACT

A reusable drinking bottle having an improved, easily cleanable, closure adapted with a drinking spout. A closure body is adapted for mating engagement in covering relation with the open top formed in a drinking bottle. A valve insert places the interior volume of the drinking bottle in fluid communication with the exterior. An actuator is removably connected to the valve insert to allow for user actuated rotation thereof between closed and open configurations. A normally closed resilient self-sealing valve allows liquid to flow from the drinking bottle through the valve insert when configured to the open configuration. The valve insert is retained by a retaining cap in threaded engagement with the valve insert on the exterior of the base. The closure of the present invention contains only a small number of components and may be easily disassembled by the user to allow for cleaning.

10 Claims, 9 Drawing Sheets

(56) References Cited

U.S. PATENT DOCUMENTS

| | | | | |
|---|---|---|---|---|
| 10,358,270 | B1 * | 7/2019 | McCready | B65D 47/263 |
| 10,532,862 | B2 * | 1/2020 | Backs | B65D 47/06 |
| D876,895 | S * | 3/2020 | McCready | D7/629 |
| 10,974,876 | B2 * | 4/2021 | Backs | B65D 47/265 |
| 2016/0200486 | A1 * | 7/2016 | Meyers | B65D 47/06 215/229 |
| 2017/0166364 | A1 * | 6/2017 | Jones | B67D 3/00 |
| 2018/0050844 | A1 * | 2/2018 | Hirst | A47G 21/18 |
| 2019/0161245 | A1 * | 5/2019 | Proudfoot | B65D 47/0809 |
| 2019/0382167 | A1 * | 12/2019 | Backs | B65D 25/48 |
| 2020/0115119 | A1 * | 4/2020 | Backs | B65D 47/265 |
| 2021/0198017 | A1 * | 7/2021 | Backs | B65D 47/06 |

* cited by examiner

TOP CLOSURE ASSEMBLY AND DRINKING BOTTLES INCLUDING THE SAME

CROSS REFERENCE TO RELATED APPLICATIONS

This application claims the benefit of U.S. Provisional Patent Application Ser. No. 62/967,405, filed on Jan. 29, 2020.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

The present invention relates generally to portable drinking containers, and more particularly to a top closure assembly for drinking bottles.

2. Description of Related Art

The use and popularity of reusable portable drinking containers has expanded significantly in recent years. Such containers typically include a main vessel for receiving and storing a liquid, such as water, sports drinks and the like. A closure is removably secured in covering relation with an opening in the top of the vessel. Many closures are adapted with a drinking spout from which the liquid may be dispensed directing into the user's mouth. Such drinking spouts come in a variety of configurations including push-pull resealable closure spouts; self-sealing spouts; and rotatable closure spouts. U.S. Pat. No. 5,465,876, issued to Crisci, discloses a drinking bottle having a push-pull resealable closure spout. Other, so called self-sealing spouts are activated when the user either bites down upon the mouthpiece and/or squeezes the bottle. An example of such a spout is found in U.S. Pat. No. 6,070,767, issued to Gardner et al., which discloses a mouthpiece for providing fluid delivery to a user via a resilient head having a face defining a normally closed slit. These valves come in various configurations and are often generally referred to as "self-sealing valves." U.S. Pat. No. 10,358,270, issued to McCready, discloses a closure assembly for drink containers having a valve insert rotatable between a closed configuration and a drink configuration. The insert is secured to the closure by a retainer disposed on the interior.

As the popularity of reusable water bottles has increased, users have experienced growing frustration with the task of keeping the water bottles clean. The difficulty and time required to clean modern reusable water bottles and particularly the associated closures/spouts increase as the structures become ever more complex. The problem is further compounded when sugar-containing beverages are used with such closures and spouts. Accordingly, there exists a need for improvements in the field of reusable drink containers.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. § 1.56(a) exists.

BRIEF SUMMARY OF THE INVENTION

The present invention overcomes the limitations and disadvantages in the art by providing a reusable drinking bottle having an improved, easily cleanable, closure adapted with a drinking spout. A drinking bottle closure in accordance with the present invention includes a closure base adapted for mating engagement in covering relation with the open top formed on a drinking bottle. The main closure defines a passage which receives a valve insert thereby placing the interior volume of the drinking bottle in fluid communication with the exterior. An actuator is connected to the valve insert and functions to allow for user actuated rotation thereof between a closed configuration wherein fluid communication between the drinking bottle interior and exterior is closed thereby preventing fluid flow, and a drinking configuration wherein fluid communication between the interior and exterior is open thereby enabling fluid flow. A normally closed resilient self-sealing valve is disposed within the valve insert to allow for liquid to flow from the drinking bottle through the valve insert when configured to the drinking configuration. The valve insert is retained by a retaining cap in threaded engagement with the valve insert on the exterior of the base. The closure of the present invention contains only a small number of components and may be easily disassembled by the user to allow for cleaning. The ability to quickly and easily disassemble, clean, and reassemble the closure provides significant advantages to the user over competitive drinking bottle closures on the market. The drinking bottle closure of the present invention is preferably used in combination with a drinking bottle having a removable bottom to facilitate cleaning of the bottle interior.

It is an object of the present invention to provide an improved, easily cleanable closure for a reusable drinking bottle.

It is another object of the present invention to provide such an easily cleanable closure for a reusable drinking bottle which has a removable bottom to facilitate cleaning of the inside of the bottle whereby the entire hydration assembly is easily cleanable.

These and other objects are met by the present invention which will become more apparent from the accompanying drawing and the following detailed description of the drawings and preferred embodiments.

DETAILED DESCRIPTION OF THE INVENTION

Figure 1:
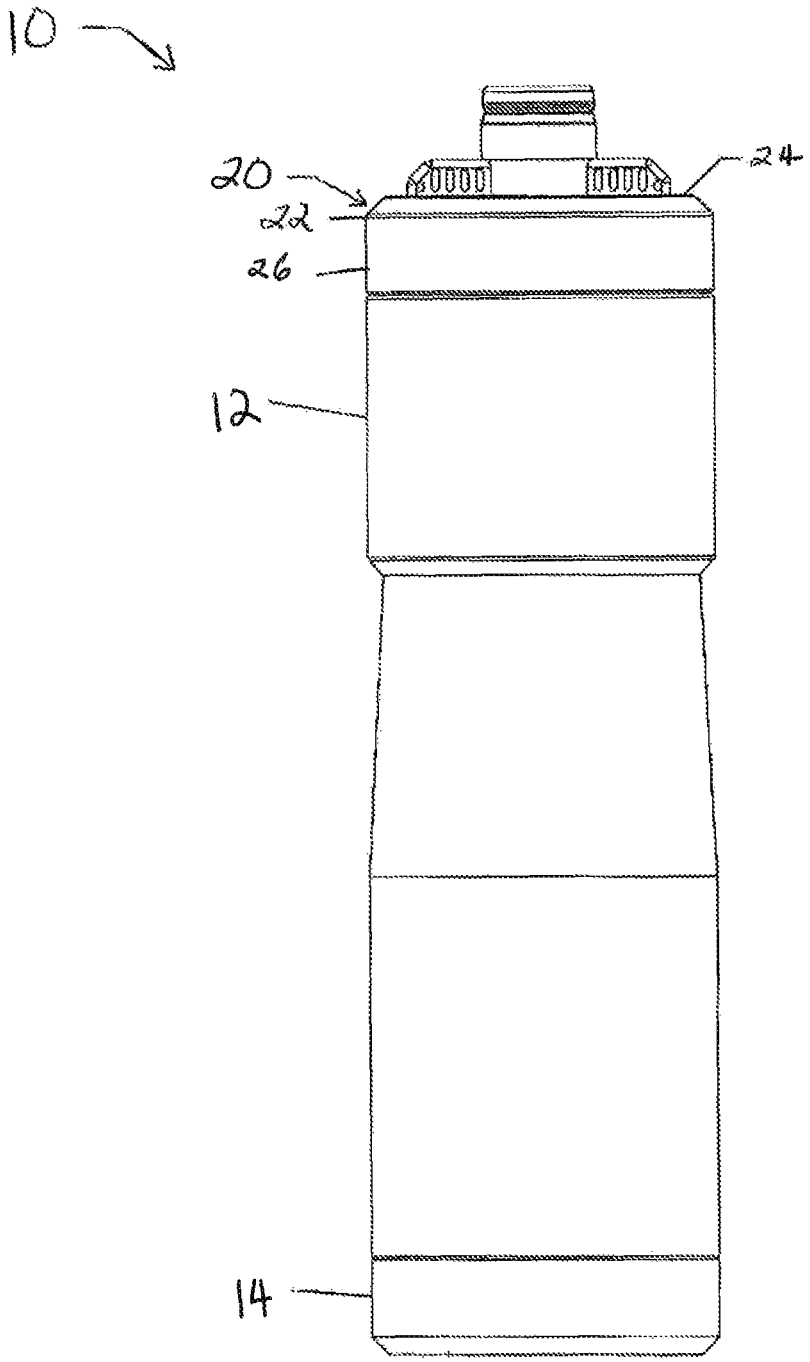
FIG. 1 is a side view of a drinking bottle adapted with a top closure in accordance with the present invention.

The present invention may be understood more readily by reference to the following detailed description taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

In describing this invention, the word "connected" is used. By "connected" is meant that the article or structure referred to is joined, either directly, or indirectly, to another article or structure. By "indirectly joined" is meant that there may be an intervening article or structure imposed between the two articles which are "connected". "Directly joined" means that the two articles or structures are in contact with one another or are essentially continuous with one another. By adjacent to a structure is meant that the location is near the identified structure.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Turning now to the drawings, FIGS. 1-9 disclose a reusable drinking bottle assembly, generally referenced as 10, including a drinking bottle 12 having an improved, easily cleanable closure 20 in accordance with the present invention. Drinking bottle 12 preferably comprises a reusable container for receiving liquids, such as water, sports drinks, energy drinks, and the like. Drinking bottle 12 may be fabricated from insulated or non-insulated material, and may further comprise a rigid or non-rigid (e.g. squeezable) structure. In accordance with one aspect of the present invention, the exterior surfaces of drinking bottle 12 and closure 20 are coated with an antimicrobial substance to prevent and/or minimize the accumulation of germs, bacteria, viruses, and other non-desirable biological contaminants. In one embodiment the antimicrobial substance includes silver ions. It is important that the antimicrobial substance is only on surfaces that do not come into contact with the drinking liquid or the user's lips/mouth as the introduction of antimicrobial substances into the human digestive tract may have negative effects on gut bacteria if ingested. Drinking bottle 12 further includes a bottom portion 14 in removable threaded engagement with drinking bottle 12. Removal of bottom portion 14 along with removal of closure 20 transforms drinking bottle 12 into an open-ended configuration that facilitates ease of cleaning of the inside of drinking bottle 12.

Figure 2:
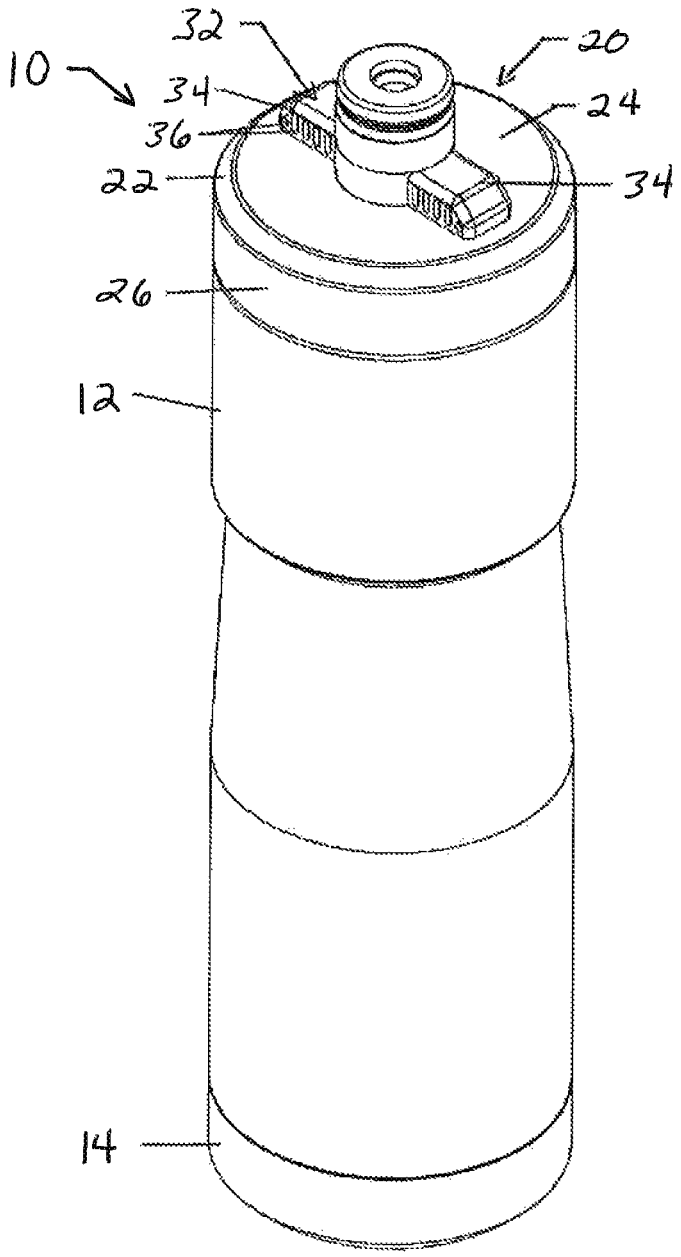
FIG. 2 is a top perspective view thereof.
Figure 3:
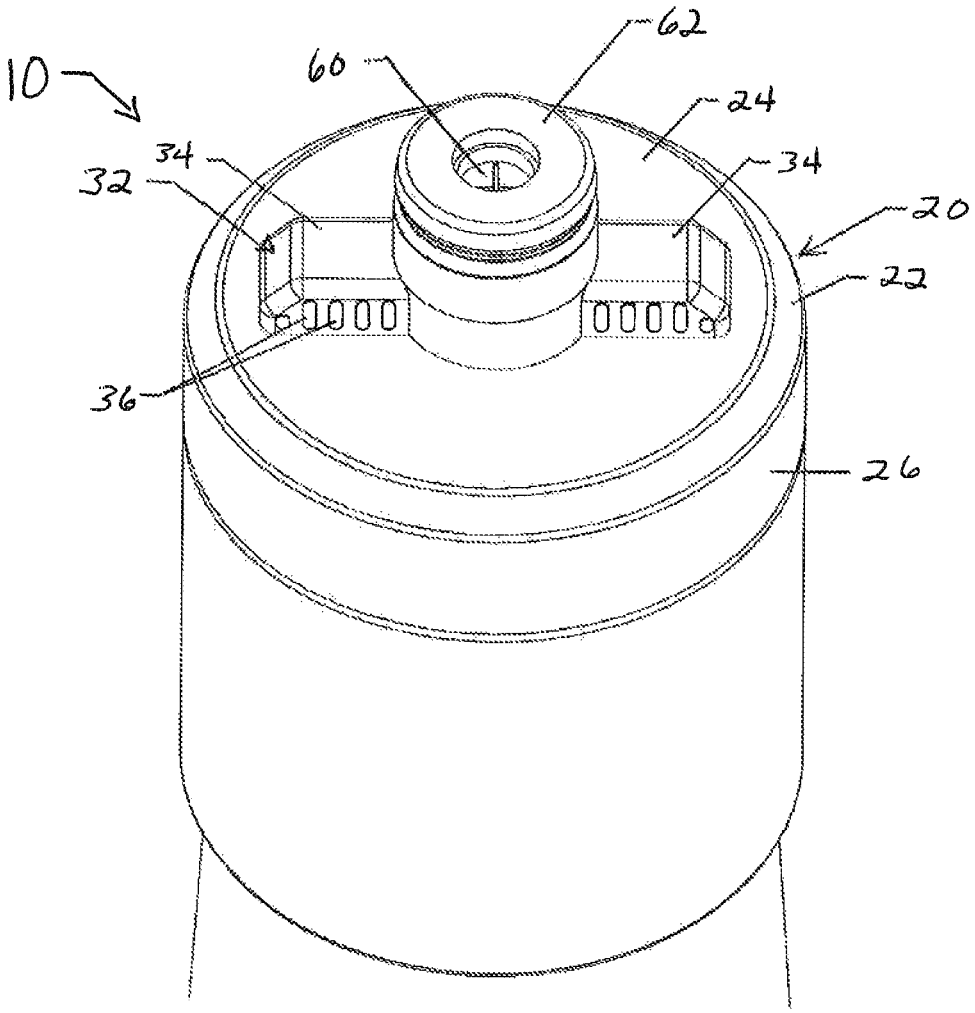
FIG. 3 is a partial top perspective view thereof.

Another significant aspect of the present invention involves providing a main closure structure 20 for a reusable drinking bottle that is easily cleanable. FIGS. 1-3 best illustrate the exterior structure of closure 20 and FIGS. 4-9 best illustrate the interior structure of closure 20. Closure 20 includes a main closure body 22 which defines a top surface 24 and an annular outer sidewall 26 projecting downward from top surface 24. Closure 20 is adapted for removable mating engagement with the top and/or a neck (not shown) formed on drinking bottle 12. In a preferred embodiment, the inner surface 28 of annular sidewall 26 defines threads to allow for mating threaded engagement with corresponding threads formed at the top and/or on the neck of drinking bottle 12. It should be apparent, however, that any installable and removable mechanical connection that forms a watertight seal between closure 20 and drinking bottle 12 is considered within the scope of the present invention.

Figure 4:
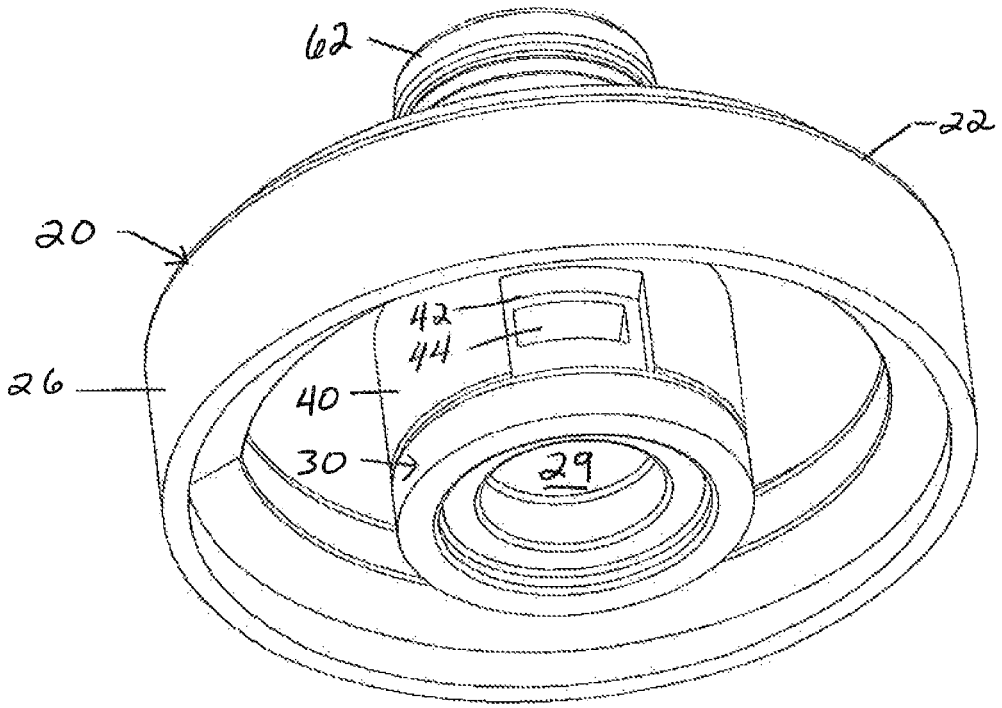
FIG. 4 is a bottom perspective view of the top closure.
Figure 5:
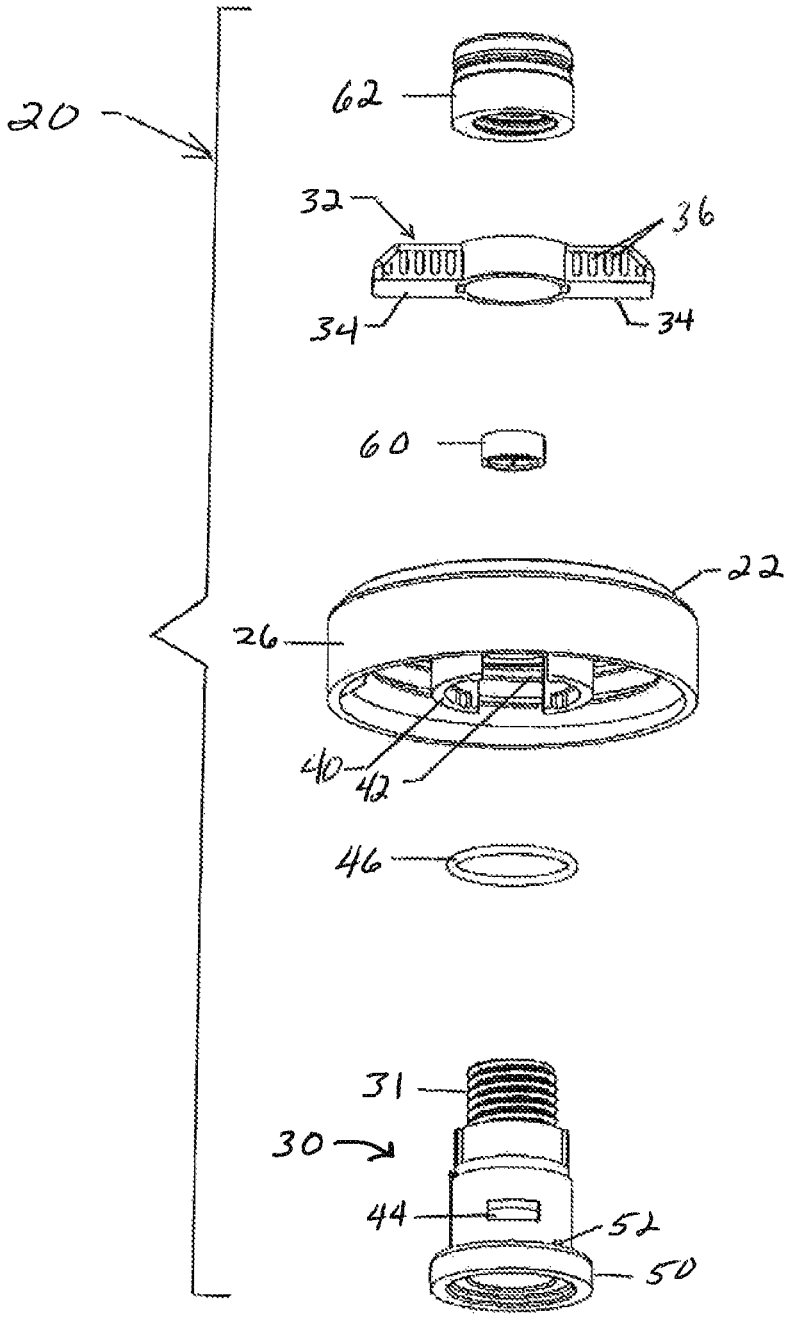
FIG. 5 is an exploded side perspective view thereof.
Figure 6:
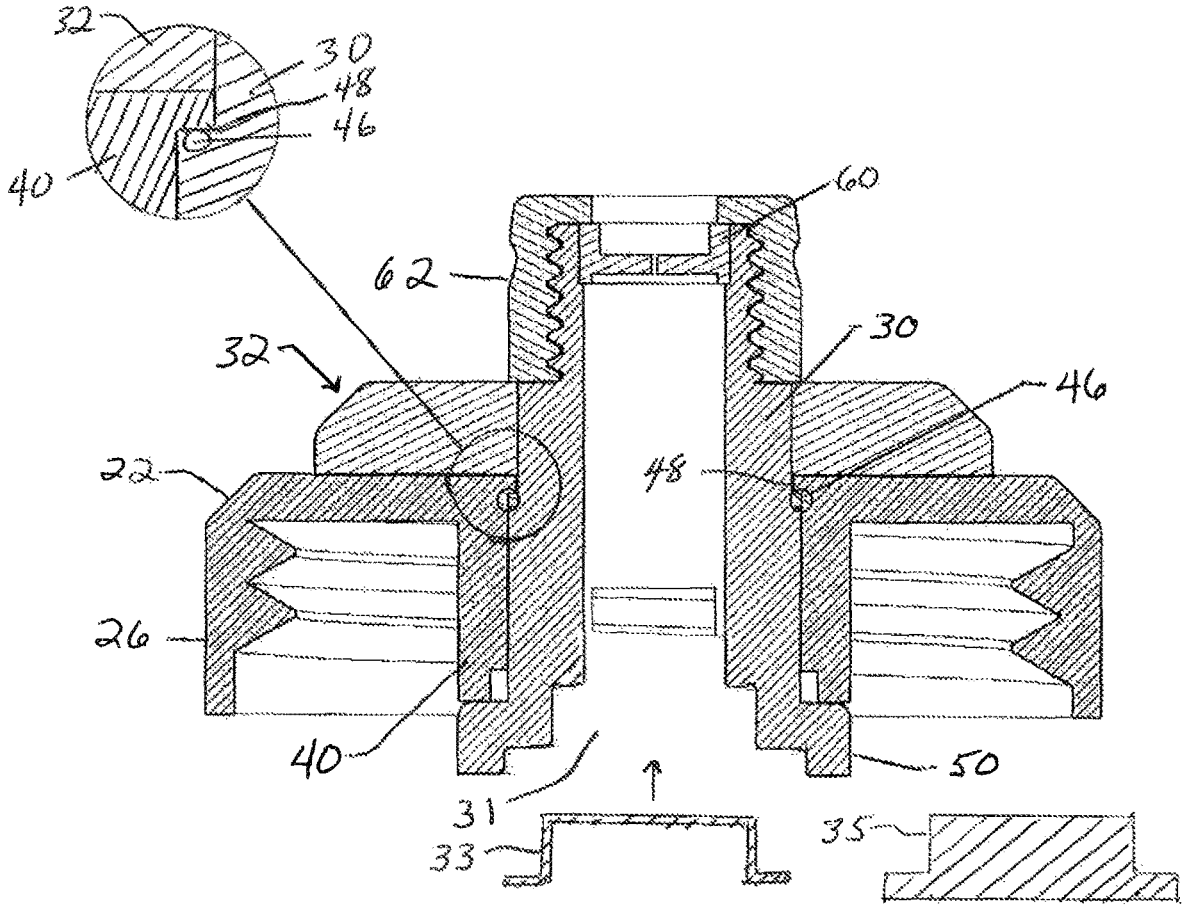
FIG. 6 is a side sectional view thereof.

As illustrated in FIGS. 4 and 5, main closure body 22 defines a passage 29 which functions to place the interior volume of the drinking bottle in fluid communication with the exterior. A valve insert, generally referenced as 30, is removably received within passage 29 and functions as a conduit for liquid flowing from drinking bottle 12 through main closure body 22. Valve inlet includes a lower portion that functions as a liquid inlet and an upper portion that functions and a liquid outlet. As illustrated in FIGS. 5 and 6, an actuator, generally referenced as 32, is connected to valve 30 and functions to allow for user actuated rotation of the valve between a closed configuration wherein fluid communication between the drinking bottle interior and exterior is closed thereby preventing fluid flow, and a drinking configuration wherein fluid communication between the interior and exterior is open thereby enabling fluid flow from the container. Actuator 32 is preferably removably connected to valve 30. Removable connection of actuator 32 and valve 30 is important in allowing full disassembly of the closure assembly to facilitate cleaning. Actuator 32 preferably includes a pair of opposing radially projecting arms 34, that function to allow for manual user rotation of valve 30 between closed and drinking configurations. Each arm 34 preferably includes a plurality of vertically disposed projecting ribs 36 which provide gripping surfaces to aid in rotatable actuation of valve 30 by the user.

FIGS. 4-7 provide detailed illustrations of the operative structures of main closure body 22 and valve 30. As best seen in FIG. 4, main closure body 22 includes an annular inner sidewall 40 disposed in surrounding relation with passage 29. Annular inner sidewall 40 defines a pair of liquid inlet notches 42. FIG. 5 depicts one of said liquid inlet notches 42 with the other of said notches being disposed on the diametrically opposed side (i.e., not seen in FIG. 4). As best illustrated in FIGS. 4, 5, and 6, valve 30 defines a pair of diametrically opposed liquid inlet ports 44. Liquid inlet ports 44 are disposed on valve 30 such that they are aligned with inlet notches 42 thereby allowing liquid within drinking bottle 20 to pass therethrough when valve 30 is rotatably disposed to the drinking configuration shown in FIG. 4. Conversely, inlet ports 44 are blocked by the inner surface of annular inner sidewall 40 when valve 30 is rotated to the closed configuration thereby preventing liquid from passing through valve 30.

As best seen in FIGS. 5 and 6, an O-ring 46 is disposed on valve 30 and forms a watertight seal with a radially inwardly projecting annular flange 48 which defines passage 28 on closure 20. Valve 30 further includes a radially outwardly projecting foot 50 disposed at the lowermost portion thereof. Foot 50 provides a stop surface that prevents valve 30 from upward movement relative to main closure 20 by engaging the bottom edge of annular inner sidewall 40.

Figure 7:
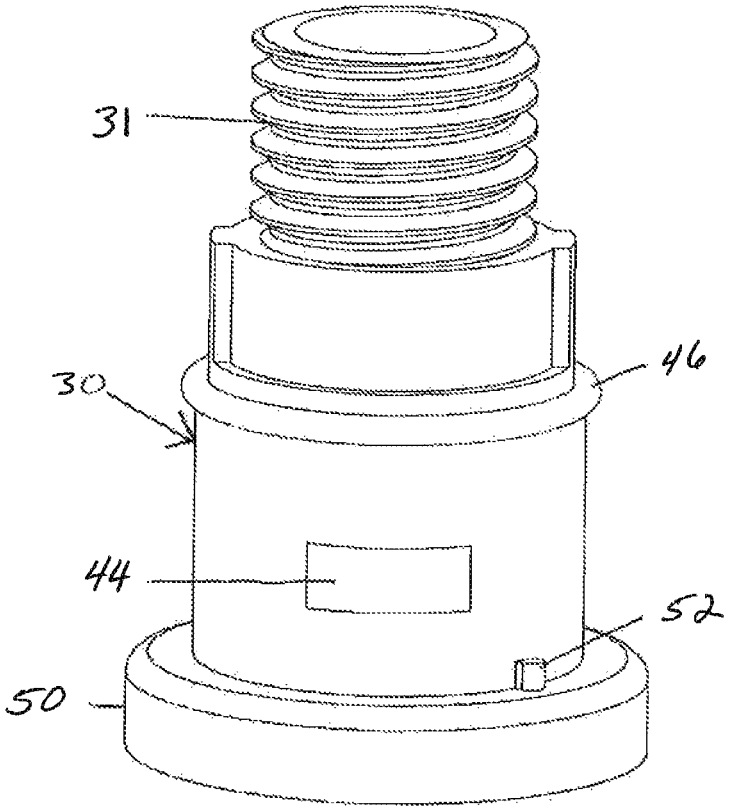
FIG. 7 is a side perspective view of the valve insert component of the top closure.
Figure 8:
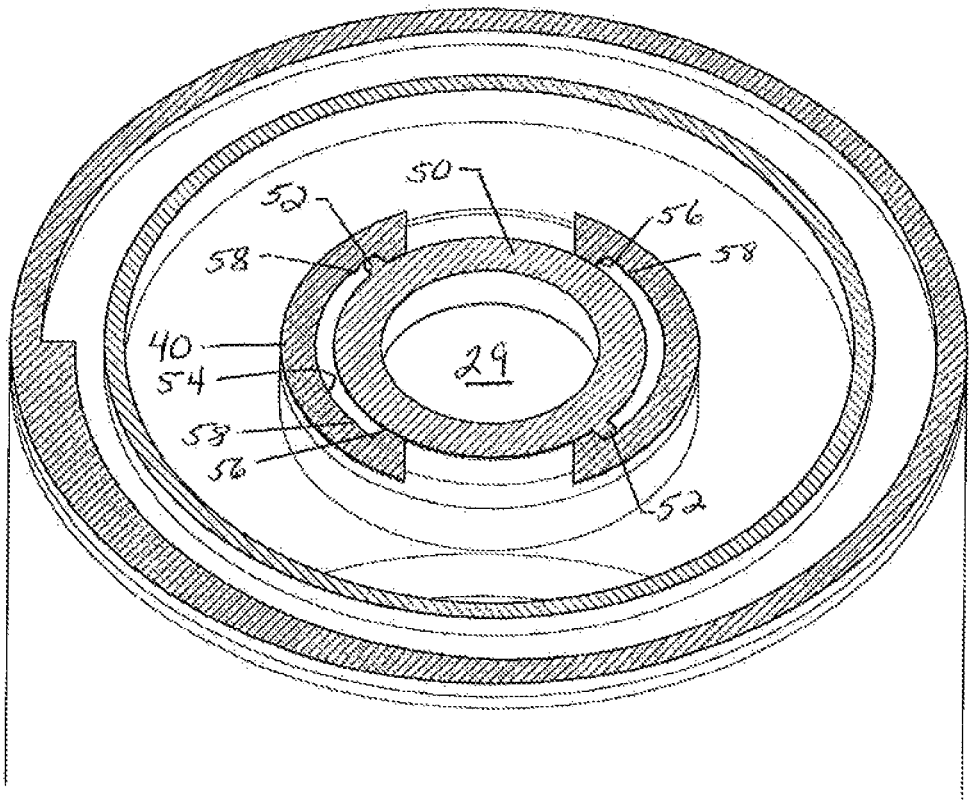
FIG. 8 is a sectional view taken through the top closure.
Figure 9:
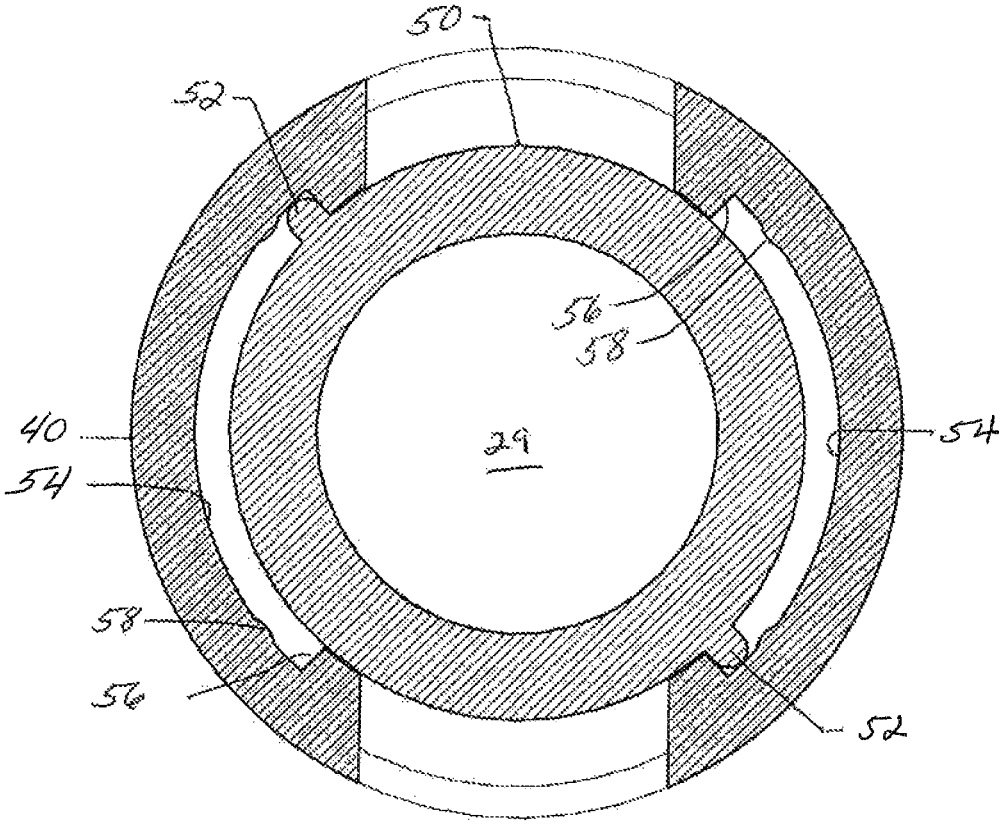
FIG. 9 is a detailed view thereof.

As best seen in FIG. 7 a boss member 52 radially projects up from foot 50 and radially outward relative to the main body of valve 30. In a preferred embodiment, a pair of boss members are disposed in diametrically opposite positions on valve 30. FIGS. 8 and 9 are sectional views illustrating the functional relationship between boss members 52 and the radially inner surface 54 of annular inner sidewall 40. More particularly, radially inner surface 54 of sidewall 40 defines an arcuate surface terminating at opposing sectional ends with rotational stop surfaces 56 and protuberance surfaces 58 in spaced relation therewith stop surfaces 56. Rotation of valve 30 to the closed position results in boss members 52 coming into engagement with stop surfaces 56 thereby preventing further rotation. In addition, a "click", is generated as boss members 52 ride over protuberances 58 which is significant in providing tactile feedback to the user indicating that the boss members have reached or exited a terminal rotational location corresponding to either a drinking configuration or a closed configuration. Further, boss members 52 remain seated between stop surfaces 56 and protuberances 58 thereby preventing unintentional movement of valve 30 between the closed and drinking configurations. As should be apparent, an equivalent result may be obtained by placing the boss members on sidewall 40 and the protuberances and stops on valve 30 without departing from the invention.

A normally closed resilient self-sealing valve 60 is disposed within valve 30 to allow for liquid to flow from the drinking bottle 12 through the valve 30 when valve 30 is configured to the drinking configuration. A retaining cap 62 defining an axial aperture 64 is connected in threaded engagement with the upper portion 31 of valve 30 on the exterior side of closure body 20 to retain valve 30 relative to the closure body. Retaining cap 62 may alternatively be connected by snap-fit engagement or any other suitable removable connecting structure. Valve 60 may be connected to retaining cap 62. Accordingly, valve 30 may be easily removed and separated from closure body 22 by removal of retaining cap 62 located on the exterior of closure body 22. Closure 20 of the present invention contains only a small number of components and may be easily disassembled by the user to allow for cleaning which is considered an important aspect of the present invention. The drinking bottle closure of the present invention is preferably used in combination with a drinking bottle having a removable bottom to facilitate cleaning of the bottle interior.

As best illustrated in FIG. 6, another aspect of the present invention relates to valve 30 defining an axial opening 31 at the bottom end thereof. A plug 33 is configured for removable insertion within opening 31 and secured to valve 30 by press fit or snap fit engagement. In a first embodiment, plug 33 may simply comprise a stopper forming a watertight seal with valve 30. In a second embodiment, plug 33 may be replaced with a modular inlet cartridge 35 adapted to allow liquid to flow therethrough. In accordance with this embodiment, liquid entering valve 30 first flows with modular inlet cartridge 35 which is specifically adapted to treat the liquid flowing therethrough prior to consumption by the user. The cartridge may be selected from a group of cartridges with functions including water filtration, flavor enhancement, and the infusion of dietary and nutritional supplements.

The instant invention has been shown and described herein in what is considered to be the most practical and preferred embodiment. It is recognized, however, that departures may be made therefrom within the scope of the invention and that obvious modifications will occur to a person skilled in the art.

What is claimed:

1. A closure assembly for use with a drinking bottle, said closure assembly comprising:
   - a closure adapted for mating engagement with the top of the drinking bottle thereby forming an enclosed interior and an exterior, said closure including a main closure body having a top surface and a side wall;
   - said closure defining a passage;
   - a valve insert removably received within said passage;
   - an actuator removably connected to said valve insert and configured to allow for user actuated rotation of said valve insert between a closed configuration wherein liquid does not flow through said valve insert, and an open configuration wherein liquid is allowed to flow through said valve insert;
   - a normally closed resilient self-sealing valve disposed within said valve insert, said self-sealing valve allowing liquid to flow from said closure in response to pressure applied thereto when said valve insert is in the open configuration; and
   - a retaining cap removably connected to a threaded upper portion of said valve insert on the exterior of said main closure body to free said valve insert for removal from said closure upon removal of said retaining cap from a position located above the top surface of said main closure body.

2. The closure assembly according to claim 1, further including at least one boss member engaging a rotational stop corresponding to each of the open and closed configurations.

3. The closure assembly according to claim 2, further including a protuberance in spaced relation with the rotational stop corresponding to each of the open and closed positions, whereby movement of said at least one boss past said protuberance produces a tactile feedback click.

4. The closure assembly according to claim 1, wherein said closure has an exterior surface coated with an antimicrobial substance.

5. A reusable personal hydration system comprising:
   - a bottle having a top defining an opening;
   - a closure adapted for removable mating sealing engagement with the top of said bottle thereby forming an enclosed interior and an exterior;
   - said closure including a main body having a top surface and an annular outer sidewall projecting downward from said top surface, an annular inner sidewall projecting downward from said top surface and defining an axial passage, said annular inner side wall defining a pair of diametrically opposed notches;
   - a valve insert removably received within said passage, said valve insert having an inlet end including a radially projecting foot disposed at the lowermost portion thereof, and a threaded upper portion, whereby said foot engages a terminal end of said annular inner sidewall when operatively installed;
   - said valve insert defining a pair of diametrically opposed liquid inlet ports;

a plug removably connected to the inlet end of said valve insert;

an rotational actuator removably connected to said valve insert and adapted to configure said valve insert between a closed configuration wherein liquid does not flow through said valve insert, and an open configuration wherein liquid is allowed to flow through said valve insert by alignment of said notches and said inlet ports;

a normally closed resilient self-sealing valve disposed within said valve insert, said self-sealing valve allowing liquid to flow from said closure in response to pressure applied thereto when said valve insert is in the open configuration; and a retaining cap removably connected to said valve insert above the top surface of said main body to free said valve insert for removal from said closure by removal of said retaining cap from a position located at said exterior.

6. The reusable personal hydration system according to claim 5, further including at least one boss member engaging a rotational stop corresponding to each of the open and closed configurations.

7. The reusable personal hydration system according to claim 6, further including a protuberance in spaced relation with the rotational stop corresponding to each of the open and closed positions, whereby movement of said at least one boss past said protuberance produces a tactile feedback click.

8. The reusable personal hydration system according to claim 5, wherein said bottle and said closure have external surfaces coated with and antimicrobial substance.

9. The reusable personal hydration system according to claim 5, wherein said plug comprises a stopper.

10. The reusable personal hydration system according to claim 5, wherein said plug comprises an inlet cartridge which allows liquid to flow therethrough.

* * * * *